US006089612A

United States Patent [19]

Tsamourgelis

[11] Patent Number: 6,089,612

[45] Date of Patent: Jul. 18, 2000

[54] METHOD OF DISTRIBUTION OF CORRESPONDENCE AND RELATED THINGS IN THE INTERIOR OF A COUNTRY AND ABROAD, BY USING POST NUMBER (P.N.)

[76] Inventor: Ilias Tsamourgelis, 8 Kleonon Street, GR-111 42 Athens, Greece

[21] Appl. No.: 09/029,560

[22] PCT Filed: Jun. 21, 1996

[86] PCT No.: PCT/GR96/00015

§ 371 Date: Mar. 2, 1998

§ 102(e) Date: Mar. 2, 1998

[87] PCT Pub. No.: WO97/02098

PCT Pub. Date: Jan. 23, 1997

[30] Foreign Application Priority Data

Jul. 4, 1995 [GR] Greece ..... 950100254

[51] Int. Cl.[7] ..... B42D 15/00

[52] U.S. Cl. ..... 283/67; 283/70; 209/584; 209/900

[58] Field of Search ..... 283/67, 70, 79, 283/80, 81, 116, 71; 364/478.12, 478.13, 478.14; 209/584, 900; 235/494

[56] References Cited

U.S. PATENT DOCUMENTS 5,476,420 12/1995 Manning ..... 283/116 X
5,746,450 5/1998 Petkovsek ..... 283/116 X
5,848,810 12/1998 Beaudoin et al. ..... 283/116 X

*Primary Examiner*—Willmon Fridie, Jr.
*Attorney, Agent, or Firm*—Herbert Dubno

[57] ABSTRACT

The method of distribution of correspondence and relative things by using Post Numbers (P.N.) facilitates the Post-Services to proceed to their delivery to the final receivers, by filling in themselves the address of the receiver-subscriber. The P.N. is a number that corresponds to a page of a file of an electronic data-base that contains the full name or trade name as well as the address of the receiver-subscriber. The sender, completes on the letter and the relative things, the full name or the trade name of the final receiver as well as the P.N. of the receiver-subscriber. The Postal-employee computerizes in a terminal PC the P.N. of the receiver-subscriber. This terminal PC is connected with the data-base, where the file with the P.N. of all the subscribers is found. In the end, the address of the receiver-subscriber is printed on a label which is placed on the letter. When the receiver-subscriber changes his place of residence or employment, he notifies the Post-Service of this change, so as to record by the method of the P.N. his new address on the letters sent to him.

4 Claims, 2 Drawing Sheets

METHOD OF DISTRIBUTION OF CORRESPONDENCE AND RELATED THINGS IN THE INTERIOR OF A COUNTRY AND ABROAD, BY USING POST NUMBER (P.N.)

CROSS REFERENCE TO RELATED APPLICATIONS

This application is a national stage of PCT/GR96/00015 filed Jun. 21, 1996 and based, in turn, upon Greek national application 950100254 of Jul. 4, 1995 under the International Convention.

FIELD OF THE INVENTION

The present invention relates to a method of distribution of correspondence and related things, in the interior of a country and abroad, by using Post Numbers (P.N.). The method facilitates the postal services of each country as they fill in themselves the address of the receiver-subscriber and so, can proceed to the prompt delivery of the correspondence and the relative things, even in case the receivers have changed their addresses.

BACKGROUND OF THE INVENTION

Up to now, when the receiver of letters and parcels (natural or legal person) changes his address in the same country, he notifies the postal services of this change. Afterwards, these services deliver the letters and the parcels to the new address of the receiver by filling in themselves the new address on them. This service is offered in Germany for a period up to 6 months, in Austria for a period of 3 months as well as in Italy for a period of 1 month starting from the date of informing of the post services.

After the expiration of this period, only some of the letters and parcels are returned to the senders. Most of them are lost and cause incalculable economic damage to the intended recipients and is a blow to their social contacts.

SUMMARY OF THE INVENTION

The Post Number is a number that corresponds in the electronic data base of the post service of a country, to a file that contains the designation elements (full name or trade name etc) and the address of the receiver-subscriber.

The Post Number is completed with codes (letters or numbers) that indicate the country and furthermore some region of the country they are destined for and in which the P.N. in question is in effect.

By applying the method of the Post Numbers that is made, according to the invention, with the support of computers, the letters, parcels and relative things circulate in the interior of a country as long as the sender has recorded on them the full name and the P.N. of the receiver, or just the P.N. that has been assigned to him by the post service of the country of his residence or employment after the potential recipient has paid his subscription. Abroad, they circulate on the basis of the Post Number completed with such codes.

If the receiver gives the P.N. of the company he works for or the P.N. of a member of his family or a third person to the senders to use it, then, it is necessary that the sender records on the letter the full name of the final receiver, in the sense of "ATTENTION OF: . . . ", so as to facilitate the selection and distribution in the company or in the family.

The receiver in question is certainly the final receiver but the post services consider as receiver the subscriber, whose address is recorded on the letters and the relative things, whereas, altogether, the handling of the letters, by the Post Services, is made on behalf of the designated recipient. The receiver-subscriber, possessor of the P.N., is responsible for the internal distribution of the letters and the related things, but, concerning this, the final receiver will have to consent from the moment that he uses the P.N. of the receiver-subscriber.

According to the present invention, one of the advantages of this method is that when the receiver-subscriber changes his address, he can notify directly the post service of this change and the post service will proceed to inform the electronic data base of the new data. In this way, although the receiver-subscriber hasn't yet notified the senders of this change and has no reason for doing this the letters will follow him to his new address as it is recorded on them not by the sender but by the post service that is kept informed of each change.

BRIEF DESCRIPTION OF THE DRAWING

One way (model) of realization of the method of the P.N. is described below, with reference to the attached figures. In the drawing.

SPECIFIC DESCRIPTION

Figure 1:
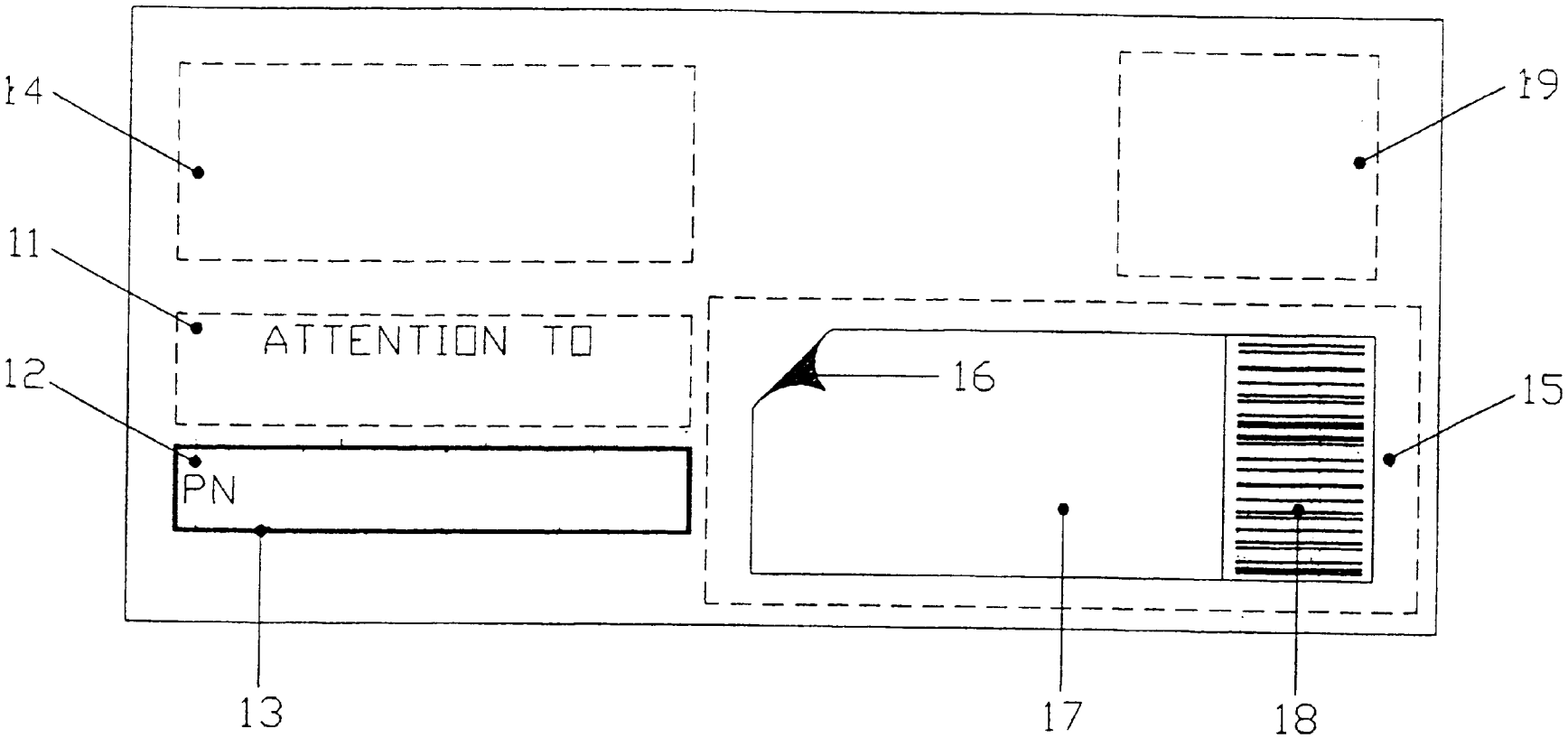
FIG. 1 is a plan view of a letter's envelope completed according to the invention.

FIG. 1 shows a model of a letter envelope equipped with a field, 11 for writing, typing or printing the name of the final receiver (to the attention of . . . ) a field, 12 for writing etc the Post Number of the receiver-subscriber a field, 14 for writing etc the elements of the sender a field, 19 for sealing or sticking on stamps a field, 15 for sticking on a label 16 on an area 17 of which 17 the full particulars of the receiver-subscriber are printed and on a field 18 carrying the necessary elements for the mechanical sorting and classification of the letters by the post office are recorded by using codes.

The color of the label or the color of the letters or the drawings on it will possibly indicate whether the letter is registered, express mail or of any other special handling, while for spotting easily the P.N. of the receiver-subscriber by the reading equipment (in case the P.N. is computerized or printed) or by the postal employee who handles the letter, there is a frame 13 around it with a continuous or discontinues line of a proportionate width and colour.

The Post Service in a country keeps a data base with Post Numbers. Those interested (natural or legal persons) by addressing themselves to the Post Office, can become its subscribers and have the right to use one or more Post Numbers, depending on the case, for a definite time. The contract between the subscriber and the Post, regarding the use of the same Post Number, can be renewed for life.

The Post Service completes each file of the data base that corresponds to a P.N. of a receiver-subscriber with his full name and his address. The subscriber may renew directly, by informing the Post, the content of this file when he changes his place of residence or employment.

Figure 2:
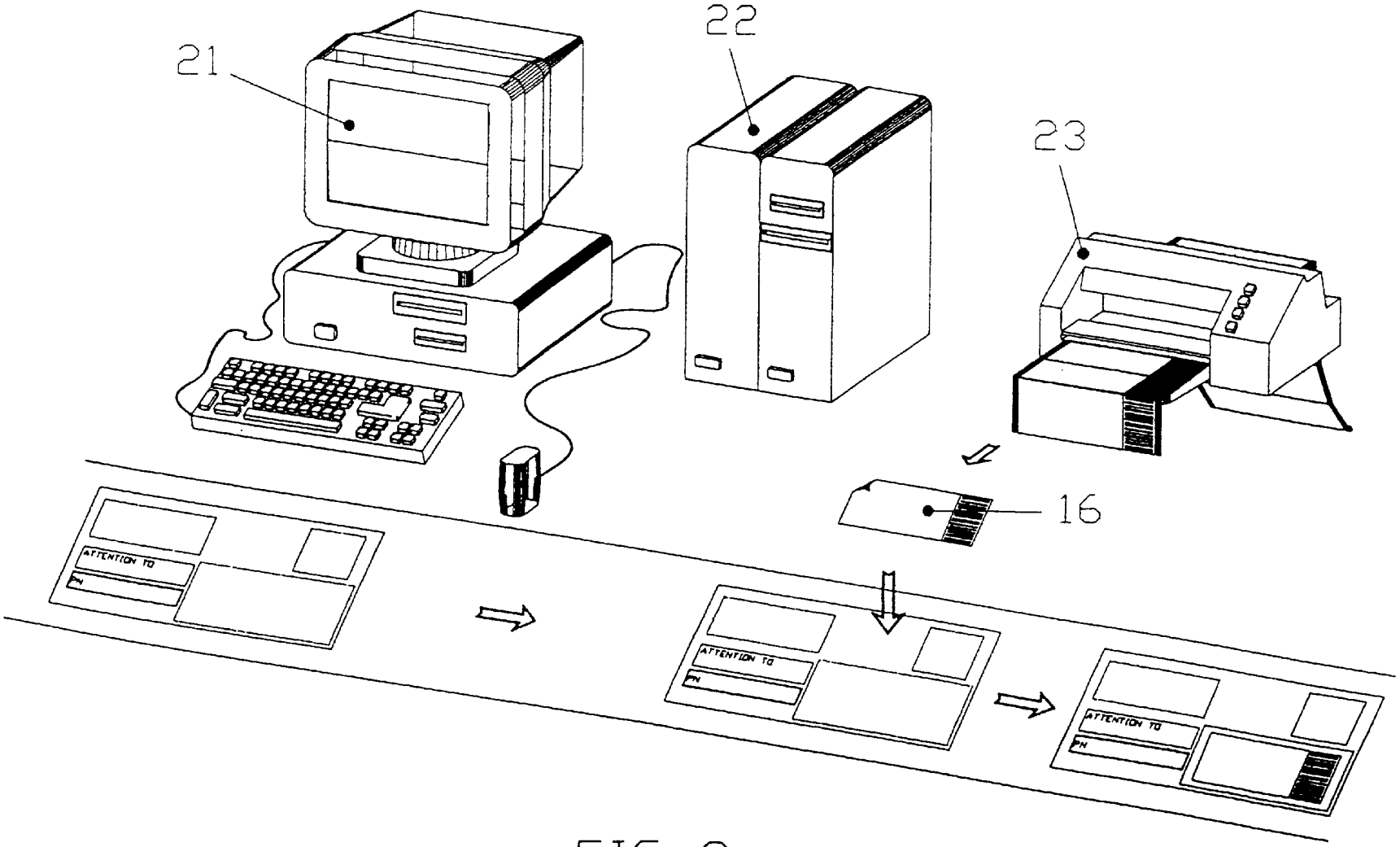
FIG. 2 is a diagram which shows an arrangement of electronic equipment that contribute, together with the employee's participation, to the realization of the invention.

By the method of the P.N., the sender completes, on the envelope of the letter or of a related thing that he addresses to the final receiver, in field 11 the full name or trade name of the final receiver and in field 12 within the frame 13 the Post Number of the receiver-subscriber, whereas in field 14 the elements of the sender are written, typed or printed. The postal employee who receives, in any post office, the letter or the relative things, handles them with the support of various types of electronic equipment. So, depending on the way it is written, he reads and computerizes in a terminal PC 21 or scans with a visual sensor connected with the PC 21, the P.N. of the receiver-subscriber, according to FIG. 2 where a system with which the invention works is shown. The terminal PC that is connected with the data base 22, where the file with the Post Numbers of all the subscribers is found, transfers to it the coded signals. After the pin-pointing of the file that corresponds to the computerized P.N., its content is transferred by coded signals to the screen 21 of the user and to the printer 23 from which we take a self-adhesive label 16 having the full particulars of the receiver-subscriber printed in field 17. (Full name or trade name, country, city, street, number, postal section and P.N. so as to cross-check it with the P.N. written by the sender).

The Post Service, in view of the mechanical way of sorting and classification of the letters and the relative things, as there are too many ways, can combine the sorting procedure with the one of imprinting of the P.N. So, in field 18 of the label 16, all the necessary information for the mechanical sorting and classification can be printed with a code.

Therefore, each time you call the file that corresponds to a P.N., you finally have printed on a label the recent information that concerns the address of the receiver-subscriber, which is placed on the letter or the relative things.

Concerning letters of abroad, for which two post offices intercede, one in the country of dispatch and the other in the country of delivery, the handling of the letters and the relative things in the country of dispatch is made on the basis of the part of the P.N. that indicates the country, and perhaps the region of the destination. In the country of delivery, all the above-mentioned procedure of sorting and distribution of the letters on the basis of the P.N. is executed by the Post Service.

Yet, in case the letter or some related thing is placed on an electronic scale, the indication of the scale can be combined with the data of the P.N., so as to have, after an electronic elaboration of the data, the amount that the sender will have to pay shown on the screen.

When the change of the receiver's-subscriber's place of residence or employment concerns a country, in which the Post Numbers' method is applied, then, the postal employee who handles the letters by computerizing the P.N. of the receiver-subscriber he gets a new number of another country and he rehandles it. In case in the country of the new residence the distribution of the letters is not made with the method of the P.N., then, the new address of the receiver-subscriber is printed on the label.

The method of the Post Numbers can be in joint use with the already existing method of distribution of letters.

What is claimed is:

1. A method of routing mail, comprising the steps of:

(a) assigning to each of a multiplicity of subscribers within a geographical area in which mail is to be routed a respective postal number characterizing a subscriber and an address at which delivery is to be effected for the respective subscriber;

(b) electronically storing data for each subscriber including subscriber identity, address and postal number in a data base covering said geographical area and maintained by a central authority;

(c) distributing postal numbers for subscribers to potential senders, whereby senders of mail can address mail destined for particular subscribers only with the respective postal number and with combinations of the respective postal number with other identifying indicia;

(d) at a distribution station within said geographical area, receiving each item of mail to be distributed within the geographical area, reading the postal number on said item, inputting the read postal number into an automatic data-base accessor, accessing the stored data for a subscriber identified by the inputted postal number, printing out the address of the stored data accessed by the inputted postal number on a label, and applying said label to the respective item;

(e) delivering items of mail to addresses indicated by the respective labels and solely on the basis of the respective postal numbers; and (f) for changes of addresses of certain subscribers, notifying said central authority to alter the addresses in said database assigned to the postal numbers of said certain subscribers without changing the postal numbers, thereby ensuring delivery to subscribers without individual notification of senders as to the change of name.

2. The method defined in claim 1 wherein the postal number of a respective subscriber is imprinted on the respective label for comparison with the inputted postal number.

3. The method defined in claim 1 wherein said label is applied to a standard envelope having fields for the name of a final receiver of the correspondence, for writing the postal number within a frame, for applying information as to the sender, for applying a stamp, and for receiving said label.

4. An apparatus for use in a method of routing mail comprising the steps of:

(a) assigning to each of a multiplicity of subscribers within a geographical area in which mail is to be routed a respective postal number characterizing a subscriber and an address at which delivery is to be effected for the respective subscriber;

(b) electronically storing data for each subscriber including subscriber identity, address and postal number in a data base covering said geographical area and maintained by a central authority;

(c) distributing postal numbers for subscribers to potential senders, whereby senders of mail can address mail destined for particular subscribers only with the respective postal number and with combinations of the respective postal number with other identifying indicia;

(d) at a distribution station within said geographical area, receiving each item of mail to be distributed within the geographical area, reading the postal number on said item, inputting the read postal number into an automatic data-base accessor, accessing the stored data for a subscriber identified by the inputted postal number, printing out the address of the stored data accessed by the inputted postal number on a label, and applying said label to the respective item;

(e) delivering items of mail to addresses indicated by the respective labels and solely on the basis of the respective postal numbers;

(f) for changes of addresses of certain subscribers, notifying said central authority to alter the addresses in said database assigned to the postal numbers of said certain subscribers without changing the postal numbers, thereby ensuring delivery to subscribers without individual notification of senders as to the change of name, said apparatus comprising a terminal for inputting a postal number;

(g) an electronic data base accessible by said terminal for outputting stored data assigned to an inputted postal number, a printer for printing said label; and (h) a computer programmed to carry out step (d).

* * * * *